US007789276B2

(12) United States Patent
Delande et al.

(10) Patent No.: US 7,789,276 B2
(45) Date of Patent: Sep. 7, 2010

(54) PRESSURIZED RECEPTACLE FOR DISPENSING A VISCOUS PRODUCT

(75) Inventors: Bruno Sadi Henri Delande, Marseille en Beauvaisis (FR); Pierre Henri Lebrand, Bonliers (FR); Jean-Francois Andre Aime Delaunay, La Chapelle Aux Pots (FR)

(73) Assignee: Nestec S.A., Vevey (CH)

( * ) Notice: Subject to any disclaimer, the term of this patent is extended or adjusted under 35 U.S.C. 154(b) by 698 days.

(21) Appl. No.: 11/568,306

(22) PCT Filed: Mar. 11, 2005

(86) PCT No.: PCT/EP2005/002580

§ 371 (c)(1),
(2), (4) Date: Oct. 25, 2006

(87) PCT Pub. No.: WO2005/102869

PCT Pub. Date: Nov. 3, 2005

(65) Prior Publication Data

US 2007/0228086 A1 Oct. 4, 2007

(30) Foreign Application Priority Data

Apr. 27, 2004 (EP) ..... 04009947

(51) Int. Cl.
*B67D 3/00* (2006.01)

(52) U.S. Cl. ..... 222/518; 222/153.11; 222/153.14; 222/402.14; 222/402.15; 222/509; 222/514

(58) Field of Classification Search ..... 222/153.14, 222/402.1, 402.15, 402.17, 518, 153.11, 222/402.14, 505, 507, 509, 513–514, 635; 137/625.33

See application file for complete search history.

(56) References Cited

U.S. PATENT DOCUMENTS

| | | | | | |
|---|---|---|---|---|---|
| 2,127,040 | A | * | 8/1938 | Mann | 222/507 |
| 3,231,153 | A | * | 1/1966 | Green et al. | 222/402.24 |
| 3,534,890 | A | * | 10/1970 | Iannacone | 222/402.14 |
| 3,804,296 | A | * | 4/1974 | Webster | 222/48 |
| 3,844,448 | A | | 10/1974 | Sette | |
| 3,861,570 | A | * | 1/1975 | Green | 222/402.17 |
| 4,378,077 | A | * | 3/1983 | Akino | 222/182 |
| 4,773,567 | A | * | 9/1988 | Stoody | 222/153.11 |
| 5,027,986 | A | * | 7/1991 | Heinzel et al. | 222/402.24 |
| 5,431,305 | A | * | 7/1995 | Kaminski | 222/109 |
| 5,713,493 | A | * | 2/1998 | Garibaldi | 222/153.06 |
| 5,749,496 | A | * | 5/1998 | DeJonge et al. | 222/153.14 |
| 6,543,650 | B1 | * | 4/2003 | Sprick et al. | 222/153.14 |
| 7,278,557 | B2 | * | 10/2007 | Rackwitz | 222/402.15 |

FOREIGN PATENT DOCUMENTS

WO WO03068632 A1 8/2003

* cited by examiner

*Primary Examiner*—Kevin P Shaver
*Assistant Examiner*—Andrew Bainbridge
(74) *Attorney, Agent, or Firm*—K&L Gates LLP

(57) ABSTRACT

A pressurized receptacle that dispenses viscous product from a container that has a dispensing valve. The dispensing valve has a valve pot that is secured in the container opening which seats a spring that biases a dispensing stack and a valve element to a closed position. The biasing position can be selectively overcome by a rotary collar that interacts with a helical ramp that can house at least one stud that drives the dispensing stack and thereby the valve element open to allow dispensation to occur.

17 Claims, 6 Drawing Sheets

PRESSURIZED RECEPTACLE FOR DISPENSING A VISCOUS PRODUCT

The present invention relates to a pressurized receptacle for dispensing viscous products, this receptacle having a dispensing valve which, for the discharge of the product, provides the discharging flow with a large cross section.

The specific problem regarding the dispensing of a high-viscosity product, such as an ice-cream for example, arises from the fact that it is vital for the dispensing valve of the receptacle to provide, on opening, a passage cross section which is sufficient to minimize the pressure drops in the flow of the product. This is because, if the pressure drop in the discharging flow of the product is too large, the product throughput is insufficient, serving only to increase the pressure prevailing inside the receptacle containing the product. Now, such a pressure increase is incompatible with the safety regulations which must be complied with, especially with regard to the packaging of food products. The problem relating to this type of dispensing operation is perfectly explained in the PCT Patent Application published under No. WO 03/068632.

In Patent Application WO 03/068632 mentioned above, a pressurized receptacle for dispensing a viscous product is described, the said receptacle comprising a container equipped with a dispensing valve, the said valve having a valve pot fastened on the container by crimping and a valve element which is secured to a dispensing stack which can be moved translationally in a sealed manner with respect to the valve pot; the valve element is subjected to the action of a spring and cooperates with a seat borne by the valve pot in order to close the valve under the action of the spring; to open the valve, it is possible to compress the spring by a lever whose point of articulation is integral with the valve pot and whose point of action is integral with the dispensing stack. In such a valve, on opening of the valve the product to be dispensed is ejected from the receptacle by passing between the valve element and its seat and then through the dispensing stack. It is possible without difficulty to increase the diameter of the dispensing stack in order, on the one hand, to reduce the pressure drops during the passage of the product and, on the other hand, to increase the throughput of the dispensed product. The result of this is that the only location where a significant pressure drop occurs is the passage between the valve element and its seat; when opened by compression of the spring, the valve element may be sufficiently removed from its seat and consequently the pressure drop at this location is dependent only on the diameter of the valve-element seat, which is limited only by the size of the crimping bead which provides fastening of the valve.

This type of valve is satisfactory from the point of view of product flow but has a major disadvantage as far as handling of the valve by the user is concerned. This is because, for opening purposes, the user must use one hand to move the lever by applying a force parallel to the axis of the receptacle and use his other hand to keep hold of the receptacle, this action not being appreciated by the users. Moreover, so that the lever can be operated even by children, it is necessary to provide the lever with a minimum length, which is disadvantageous because the lever then projects beyond the side of the receptacle, this projection being inconvenient for storing the receptacle and being unattractive as well. This observation is all the more pertinent because the force exerted by the spring to close the valve is necessarily high to allow closure to take place very quickly if the user releases his action on the lever, this measure being required to ensure the safety of the dispensing operation.

In order to solve the problem set out hereinabove, the aim of the present invention is to propose a receptacle comprising a dispensing valve of the same type as described above; the solution to the problem set is provided by the fact that the operation of the said valve is carried out by means of a rotary actuator, which overcomes the disadvantage of the projecting lever of the prior-art system cited hereinabove while retaining the advantages relating to the low level of pressure drops during dispensing. Furthermore, the operation of the actuator of the receptacle according to the invention is appreciated by the users in terms of handling and requires only little effort to initiate opening because of the reduction mechanism that is provided by the use of a system of helical ramps. Finally, the receptacle proposed by the invention allows the dispensing operation to proceed safely, especially in the event of the viscosity of the product being accidentally reduced, for example in the case of ice-creams due to an increase in temperature: specifically, in such a case, according to the invention it is sufficient for the user to release the action of his fingers on the rotary actuator in order to terminate the dispensing operation by closing the valve under the action of a spring whose force may be large owing to the reduction obtained by the helical ramps as indicated hereinabove.

The subject of the present invention is therefore a pressurized receptacle for dispensing a viscous product, the said receptacle comprising a container equipped with a dispensing valve, the said valve having a valve pot fastened on the container and a valve element which is secured to a dispensing stack which can be moved translationally in a sealed manner with respect to the valve pot and which is subjected to the action of a spring, the said valve element cooperating with a seat bome by the valve pot in order to close the valve under the action of the spring, it being possible to compress the spring in order to open the valve by an operating means which can be actuated by a user, the said operating means acting on the dispensing stack while bearing on the container such that the product to be dispensed is ejected from the receptacle through the valve and the dispensing stack, characterized in that, on the one hand, the dispensing stack bears on its outside, on the side directed away from the valve, at least one helical ramp of the same axis as the valve and in that, on the other hand, the operating means is a rotary collar fixed in translation with respect to the container, the said collar having at least one stud which can cooperate with the helical ramp or ramps in order to cause a translational movement of the dispensing stack when the collar is rotated.

In a preferred embodiment, the stud or studs of the collar can be moved substantially radially with respect to their helical bearing ramp or ramps between a first position in which there is cooperation of the stud with its associated ramp under the effect of an action by the user, and a second position in which there is no stud/ramp cooperation; the collar preferably consists of a base fastened on an attachment means for the container and of a support for the stud or studs; the collar can bear two diametrically opposed studs and the support for the stud or studs can have an elastic arm for each stud, it being possible for the user to act simultaneously on the two elastic arms to cause stud/ramp cooperation.

Advantageously, the dispensing stack has a body of revolution about an axis and the two helical ramps are symmetrical with respect to the said axis; each of the elastic arms of the collar can be joined by one of its ends to the base and can bear a stud at its other end.

Provision can be made for the region of the container where the valve is fastened to be a body of revolution about an axis and for the attachment means for the container to be a crimping bead that is a body of revolution about the said axis, the said bead providing the connection between the container and a crimping flange of the valve pot.

In an advantageous embodiment, the dispensing stack consists of two coaxial cylindrical parts, one being a valve-element holder which is secured to the valve element and slides in a sealed manner in the valve pot, the other constituting a dispensing end-piece which forms a liner inside the valve-element holder; the valve-element holder can have a peripheral flange, the spring being a helical spring arranged between the said flange and the bottom of a cylindrical region of the valve pot in the form of a pocket, the sliding of the valve-element holder being guided with respect to the valve pot by that wall of the pocket which is closest to the axis of the stack, sealing being provided between the valve-element holder and the said wall of the pocket.

Provision can be made for the dispensing end-piece to bear on its outside the two helical ramps of the dispensing stack and to have a cylindrical housing in the form of a pocket which can be fitted over the part of the valve-element holder situated on that side of its flange where the valve element is not located; the flange of the valve-element holder can have at least one slot which receives a tongue integral with the dispensing end-piece, the said tongue providing, by snap-fastening, a removable coupling between the dispensing end-piece and the valve-element holder to allow uncoupling of the said end-piece.

Given that the action of the studs on the helical ramps during the rotation of the collar entails the risk of causing the dispensing stack to rotate in spite of the presence of the sealing provided between the said stack and the valve pot, provision is made for the dispensing stack and the valve pot to be able to be prevented from rotating relative to one another by an arrangement of grooves and ribs parallel to the axis of the said stack; the valve pot can have on its inside two diametrically opposed pairs of ribs and the dispensing stack can have, at its periphery, two corresponding pairs of grooves; the tongue of the dispensing end-piece can be positioned between the two grooves of a pair of grooves of the dispensing stack.

Advantageously, the collar bears on the inner face of its base a boss which is placed in a window made in the valve pot on that side of the crimping flange where the valve element is not located; when the user rotates the collar, the boss comes out of its window by deformation of the base and the position of the said window on the valve pot corresponds, when the boss is housed therein, to a position of the collar in which the two studs are in line with the bottom points of the two helical ramps. Preferably, at least one helical ramp has at its top part a stop limiting the rotation of the collar: when, by rotation of the collar, the studs come into contact with the said stop, the dispensing stack and the valve element have been pushed down to the maximum extent, thus resulting in the maximum opening of the valve, which corresponds to the maximum throughput of the receptacle.

To provide a clearer understanding of the subject of the invention, a description will be given hereinbelow, by way of purely illustrative non-limiting example, of an embodiment represented in the appended drawing.

Figure 1:
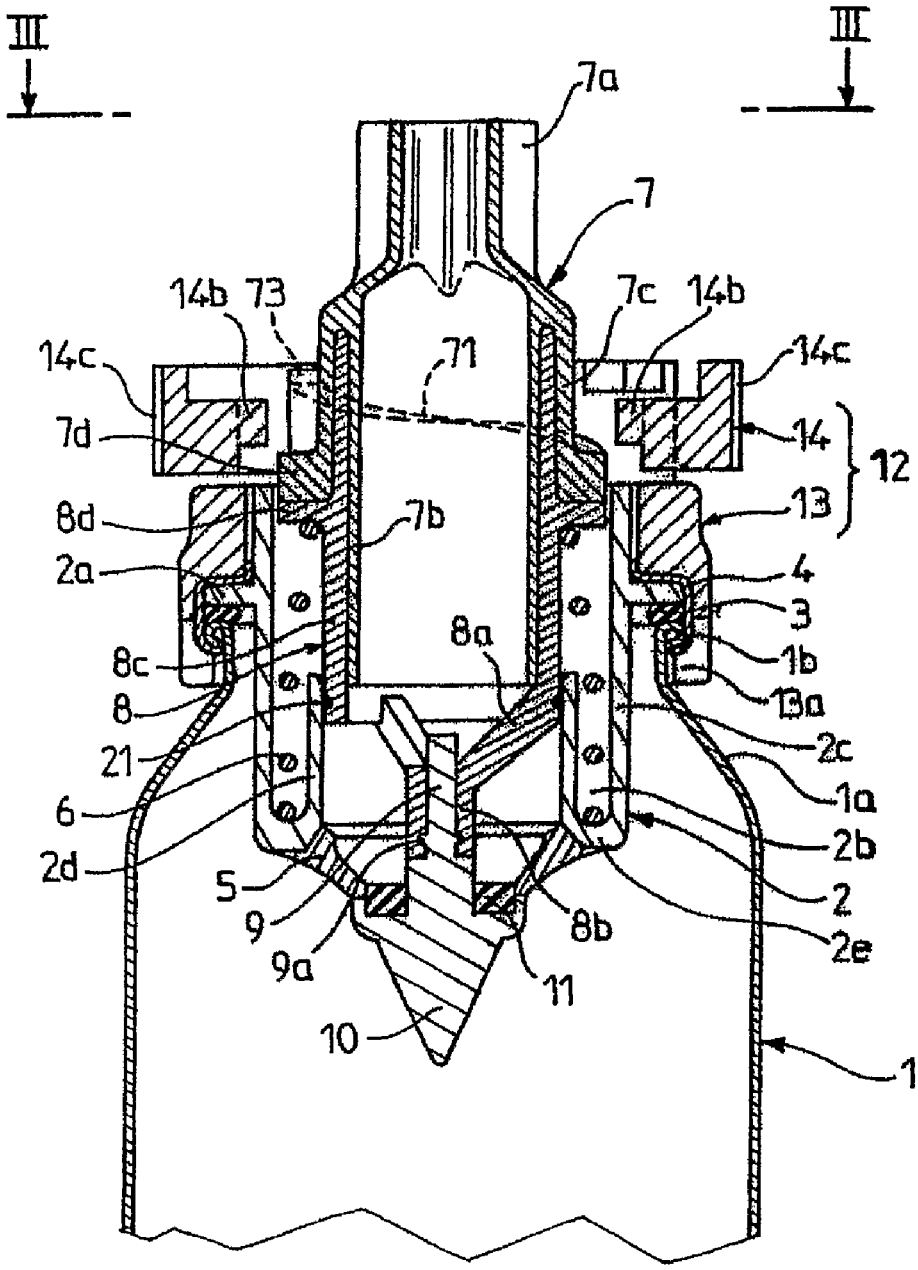
FIG. 1 represents in axial section of the receptacle according to the invention in the position corresponding to a closure of the valve, the section being taken on I-I of FIG. 3.

With reference to the drawing, it can be seen that the metal container of the pressurized receptacle according to the invention has been denoted by 1. This container 1 has a cylindrical shape and it opens to the outside via the collar of a conical neck 1*a*, the said collar being configured with a crimping bead 1*b* which surrounds the circular opening through which the inside of the container 1 communicates with the outside in the absence of any device fastened on the said crimping bead. A dispensing valve which has a valve pot 2 of cylindrical shape is fastened on the container 1, the valve pot 2 being equipped with a crimping flange 2*a* which is intended to bear on the crimping bead 1*b*, with interposition of a seal 3. The valve pot 2 is fastened on the container 1 in a known manner by means of a metal washer which is crimped to form a ring 4; the said ring 4 clamps the crimping bead 1*b*, the seal 3 and the flange 2*a* while additionally extending a little way vertically along the cylindrical wall of the valve pot, which is adjacent to the crimping flange 2*a*, on that side where the crimping bead 1*b* is not located.

The valve pot 2 has in its bottom part, that is to say in its part which is inside the container 1, a region constituting a cylindrical pocket 2*b* delimited between the outer cylindrical wall 2*c* of the valve pot 2, an inner cylindrical wall 2*d* coaxial with the cylindrical wall 2*c* and a wall 2*e* constituting the bottom of the pocket 2*b*, the said wall 2*e* being substantially perpendicular to the common axis of the cylindrical walls 2*c* and 2*d*. The wall 2*e* is secured to a frustoconical valve-element seat 5. A helical spring 6 has been placed in the cylindrical pocket 2*b*, the upper part of which spring has a diameter which is slightly smaller than the diameter of the lower part, which is housed in the cylindrical pocket 2*b*.

The valve of the receptacle according to the invention additionally has a dispensing stack which consists of two parts, namely a dispensing end-piece denoted by 7 in its entirety and a valve-element holder denoted by 8 in its entirety. The valve-element holder 8 consists of a cylindrical wall 8*c* which bears at its lower part, that is to say to the inside of the container 1, three star-shaped arms 8*a* which originate from the cylindrical wall 8*c* of the valve-element holder 8 and terminate in a sleeve 8*b* whose axis is coincident with the axis of the cylindrical wall 8*c* of the valve-element holder 8. The sleeve 8*b* receives the connecting stem 9 of a conical valve element 10, the said connecting stem 9 being held in the sleeve 8*b* by a snap-fastening bead 9*a*. The conical tip of the valve element 10 points downwards and the large base of the cone formed by the valve element 10 has a housing in which a seal 11 in the form of a circular washer is placed, the said washer surrounding the connecting stem 9. The cylindrical wall 8*c* cooperates, by way of its bottom end, with the cylindrical wall 2*d*, with interposition of an O-ring seal 21; the cylindrical wall 2*d* constitutes a sliding guide for the valve-element holder 8. The cylindrical wall 8*c* of the valve-element holder 8 has on its outside a peripheral flange 8*d* which is located approximately halfway between the two ends of the said cylindrical wall 8*c*. The spring 6 is placed between the wall 2*e* of the cylindrical pocket 2*b* and the peripheral flange 8*d*; the spring 6 bears on the peripheral flange 8*d* in the region where the flange 8*d* joins the cylindrical wall 8*c* of the valve-element holder 8.

The dispensing end-piece 7 is the part which defines the outlet duct 7*a* of the dispensed product. In the embodiment represented in the drawing, this outlet duct 7*a* has a star-shaped passage cross section, but it is clear that the duct 7*a* can have any cross section. The dispensing end-piece 7 has a cylindrical wall 7*b* which constitutes an inner liner for the valve-element holder 8. That part of the dispensing end-piece 7 which is located between the outlet duct 7*a* on the one hand and the level of the peripheral flange 8*d* on the other hand forms a cylindrical pocket in which is housed that part of the cylindrical wall 8*c* which is located above the peripheral flange 8*d*, that is to say on that side of this peripheral flange where the spring 6 is not located. The dispensing end-piece 7 can thus be assembled on the upper part of the valve-element holder 8; the reference 7*c* has been used to denote the outer cylindrical wall which, together with the inner cylindrical wall 7*b*, defines the cylindrical pocket in which the upper part of the valve-element holder 8 is placed. The base of the cylindrical wall 7*c* constitutes a ring 7*d* whose underside rests on the peripheral flange 8*d*. The upper side of the ring 7*d* forms two helical ramps 71, 72 which are symmetrical to one another with respect to the axis of the dispensing end-piece 7. Each of these helical ramps terminates at its top point in a stop 73.

Figure 2:
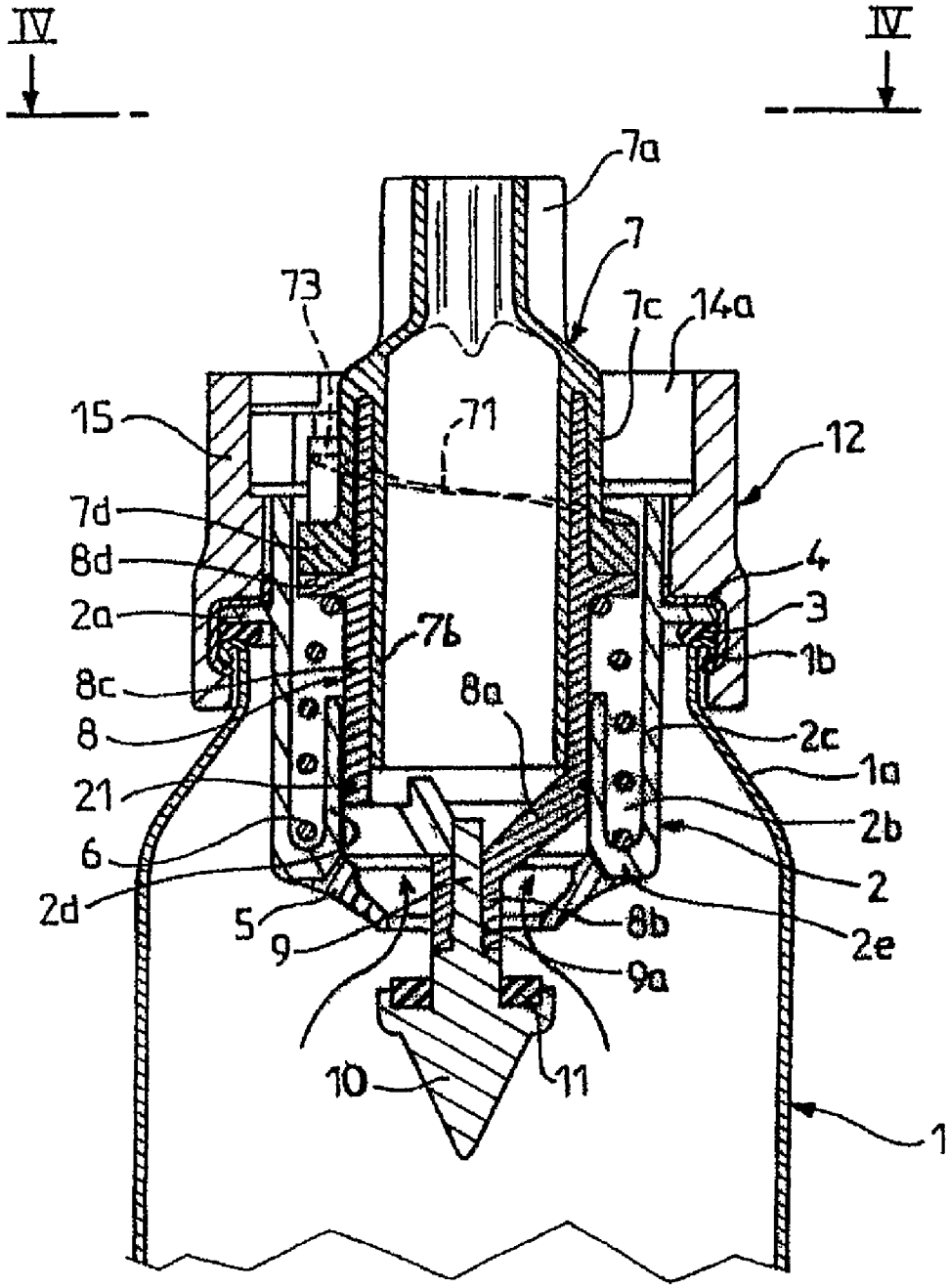
FIG. 2 represents in axial section the receptacle of FIG. 1 in the position corresponding to a maximum opening of the valve, the section being taken on II-II of FIG. 4.
Figure 3:
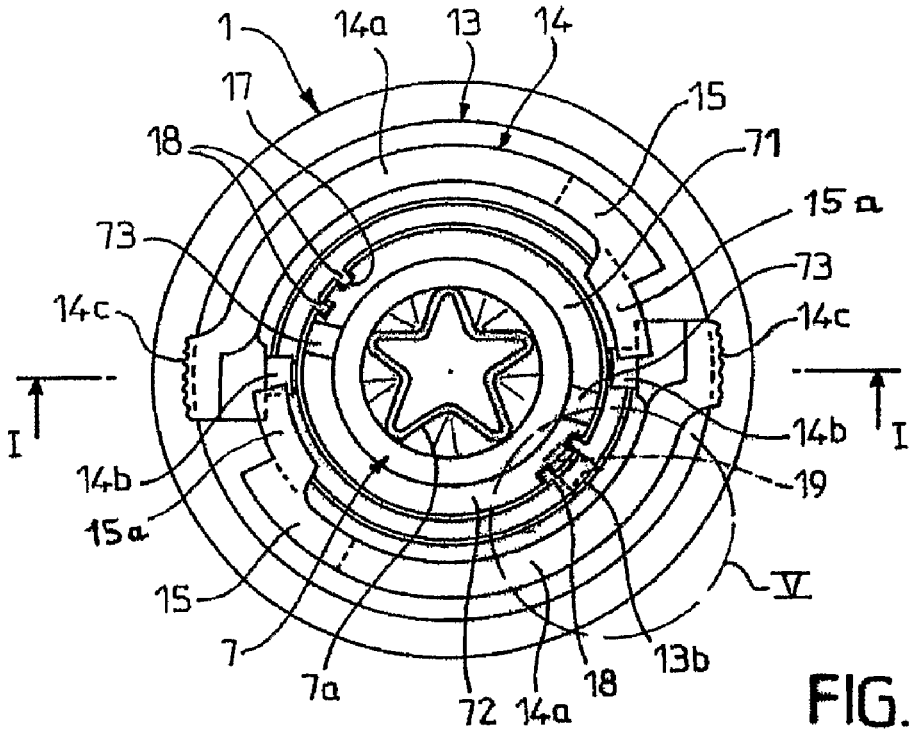
FIG. 3 represents a plan view on III-III of FIG. 1.

The valve whose main elements have just been described is in the closed position when the spring 6 brings the seal 11 of the valve element 10 against the seat 5 under the action of the spring 6, which is represented in FIG. 1. The valve moves to the open position (see FIG. 2) when the spring 6 is compressed in order to lower the dispensing stack 7-8 into the valve pot 2, this action driving the valve element 10: the product to be dispensed then passes between the valve element 10 and the valve-element seat 5; it passes through the region where the arms 8*a* are arranged, rises in the duct defined by the cylindrical wall 7*b* and escapes to the outside via the outlet duct 7*a*.

Figure 7:
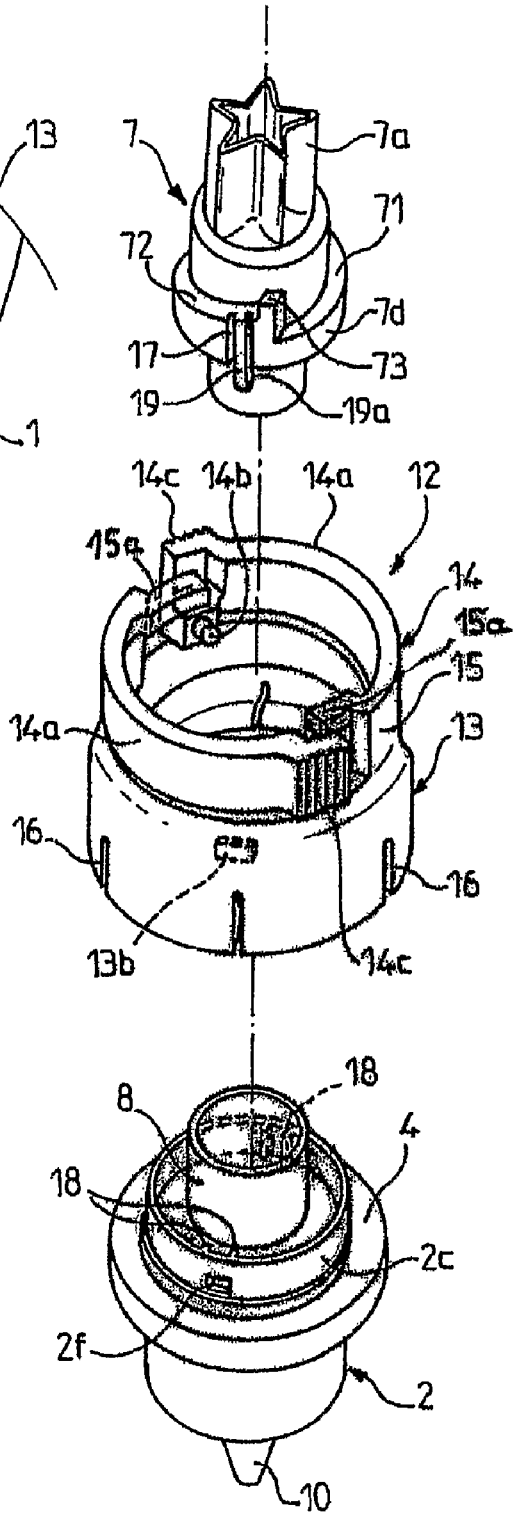
FIG. 7 represents an exploded perspective view of the three main subassemblies of the valve of the receptacle according to the invention.
Figure 8:
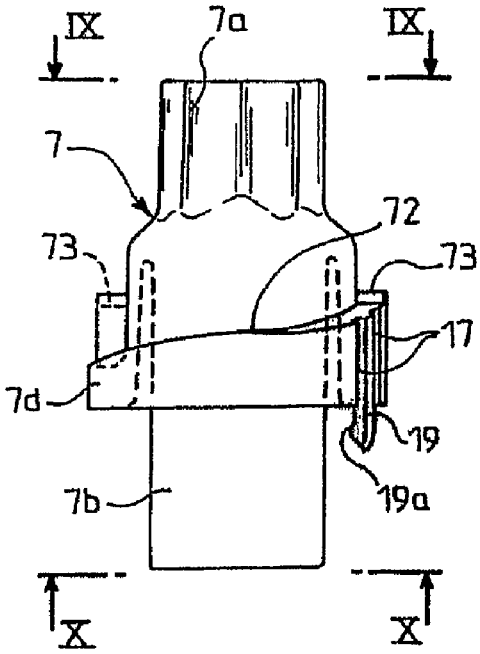
FIG. 8 represents an elevation view of the dispensing end-piece on VIII-VIII of FIG. 9.
Figure 9:
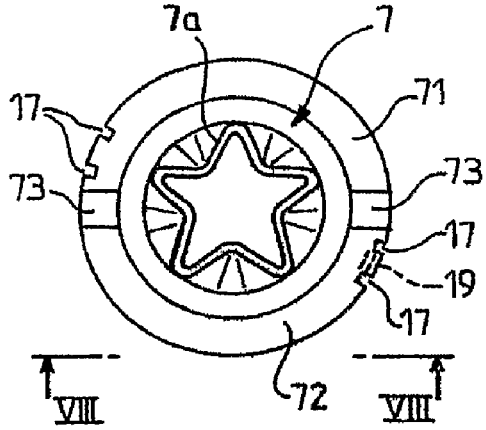
FIG. 9 represents a plan view of the dispensing end-piece on IX-IX of FIG. 8.
Figure 10:
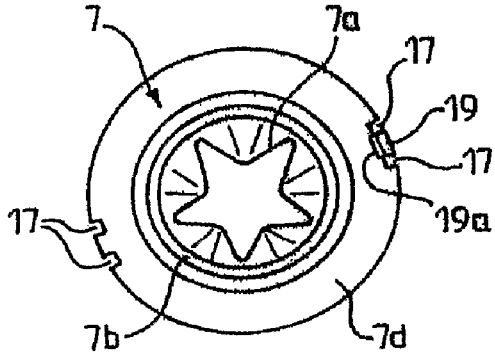
FIG. 10 represents a plan view of the dispensing end-piece on X-X of FIG. 8.
Figure 11:
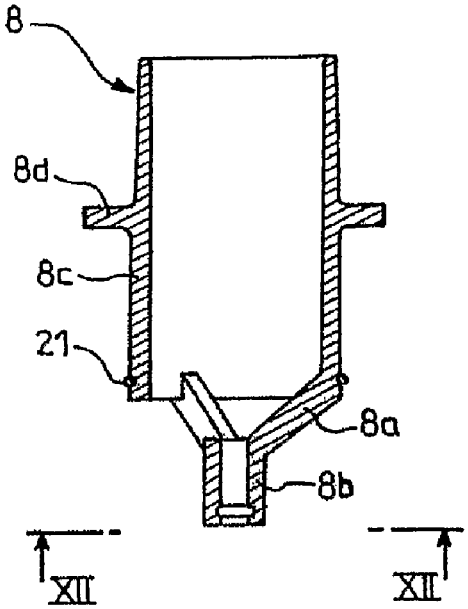
FIG. 11 represents a view in axial section of the valve-element holder (not equipped with its valve element) on XI-XI of FIG. 12.
Figure 12:
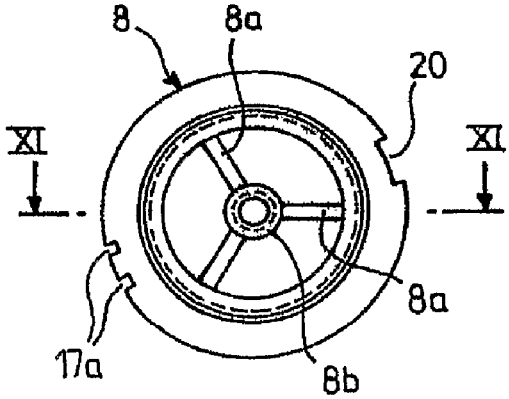
FIG. 12 represents a plan view of the valve-element holder on XII-XII of FIG. 11.

In order to compress the spring 6, a collar denoted by 12 in its entirety is used to act on the helical ramps 71, 72. The collar 12 consists of two subassemblies connected to one another, namely a base denoted by 13 in its entirety and a support for studs which is denoted by 14 in its entirety. The two subassemblies 13 and 14 of the collar 12 are moulded in one piece to form the said collar 12 and are interconnected by two connection regions 15, the said connection regions 15 being clearly visible in FIGS. 2 and 7; outside the regions 15, the two sub-units of the collar 12 are separated from one another.

The base 13 is fitted over the upper part of the valve pot 2 at the periphery of the latter. The upper part of the base 13 surrounds the valve pot 2 in its part situated above the crimping flange 2*a*; the lower part of the base 13 constitutes a skirt which surrounds the crimping ring 4 and which, via an annular boss 13*a*, snap-fastens below the said crimping ring 4. The establishment of this snap-fastening of the base 13 on the crimping ring 4 is made possible by the presence of slits 16 which are arranged at regular spacings around the periphery of the base to give the skirt the required flexibility for snap-fastening. The base 13 is thus kept in place on the container 1 without the possibility of translational movement with respect to the axis of the container, but it is free to rotate about the said axis, the rotation taking place around the ring 4, which acts as a guide.

The support 14 for the studs has two elastic arms 14*a* which are symmetrical with respect to the axis of the collar 12. Each of these arms 14*a* is joined by one of its ends to one of the connection regions 15 and bears at its other end a stud 14*b* which is arranged radially in line with a press pad 14*c* intended for the user's fingers to act on the arms 14*a*; each arm 14*a* has a shape approximating that of a semicircle when seen in plan view along the axis of the collar 12. When the user is not pressing on the pads 14*c*, the elasticity of the arms 14*a* makes it impossible for the studs 14*b* to come into contact with the helical ramps 71, 72. By contrast, when the user exerts a radial pressure on the pads 14*c*, the studs 14*b* can come into contact with the said helical ramps.

Figure 4:
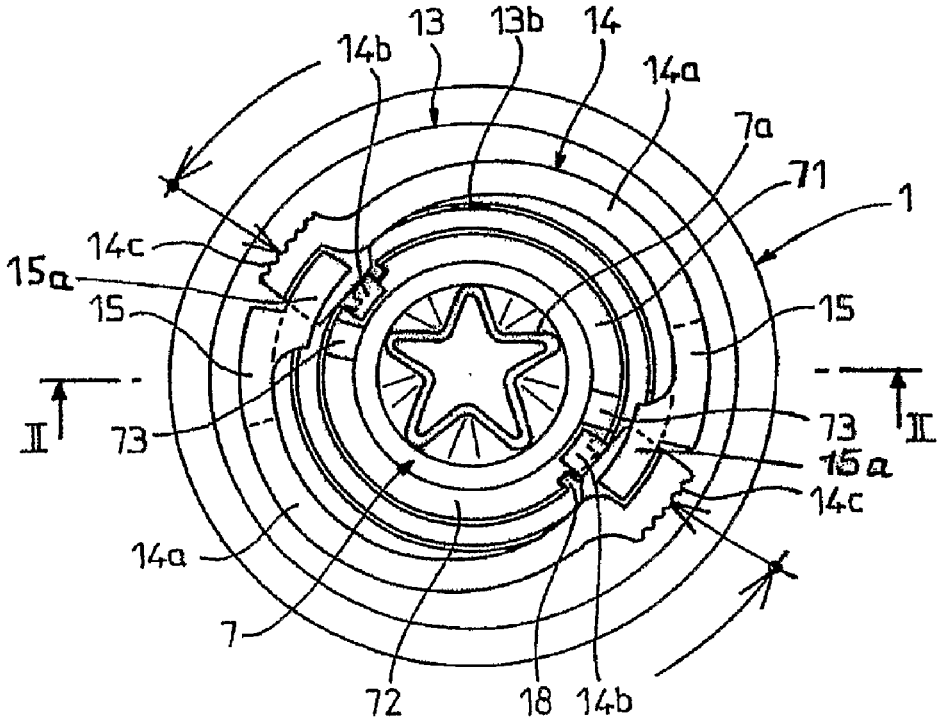
FIG. 4 represents a plan view on IV-IV of FIG. 2.
Figure 5:
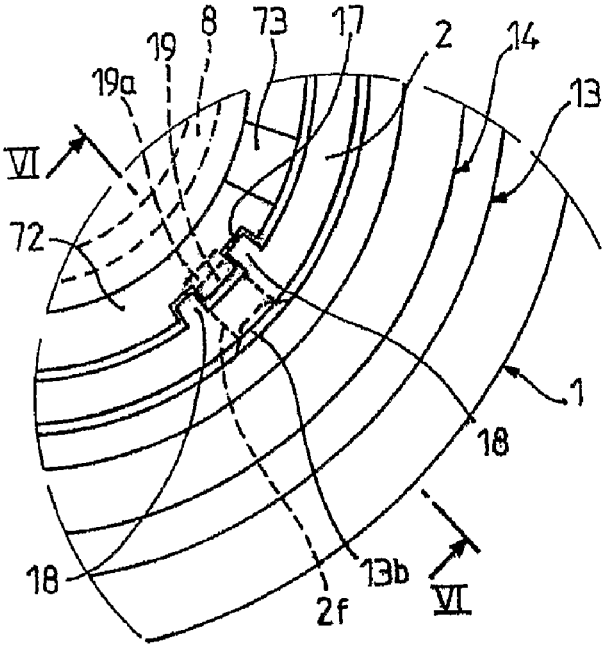
FIG. 5 represents a detail V of an area of FIG. 3.
Figure 6:
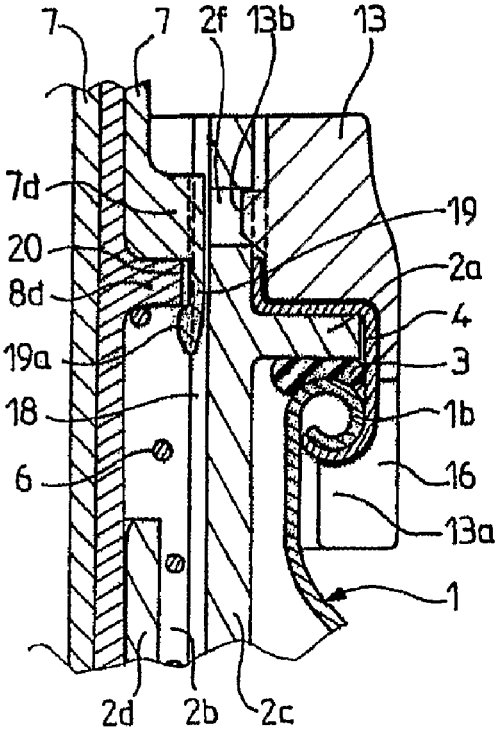
FIG. 6 represents a section on VI-VI of the detail of FIG. 5.
Figure 13:
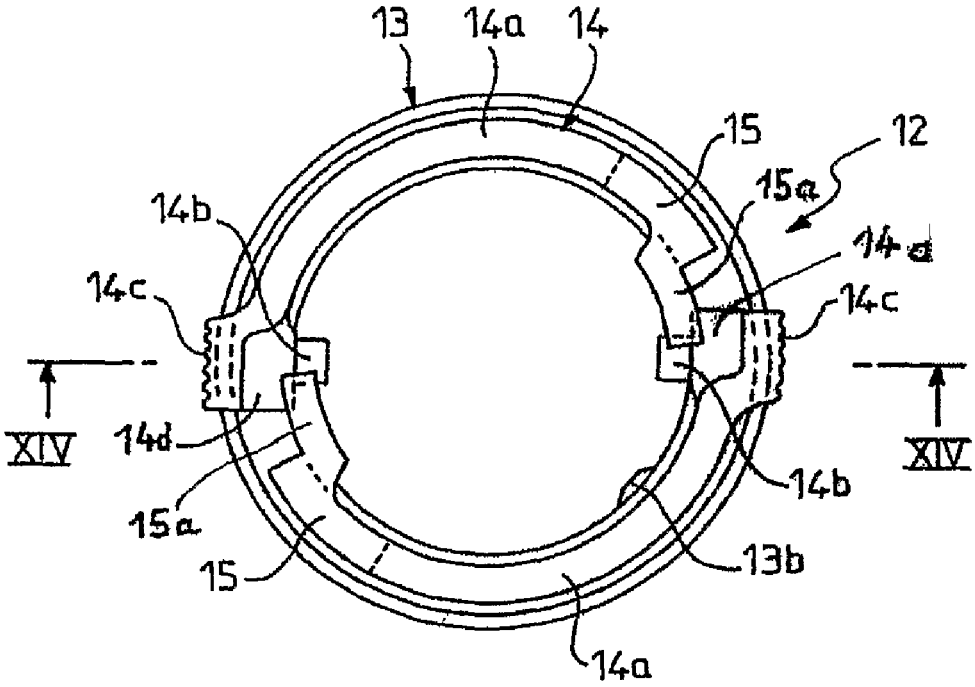
FIG. 13 represents a plan view of the rotary collar on XIII-XIII of FIG. 14.
Figure 14:
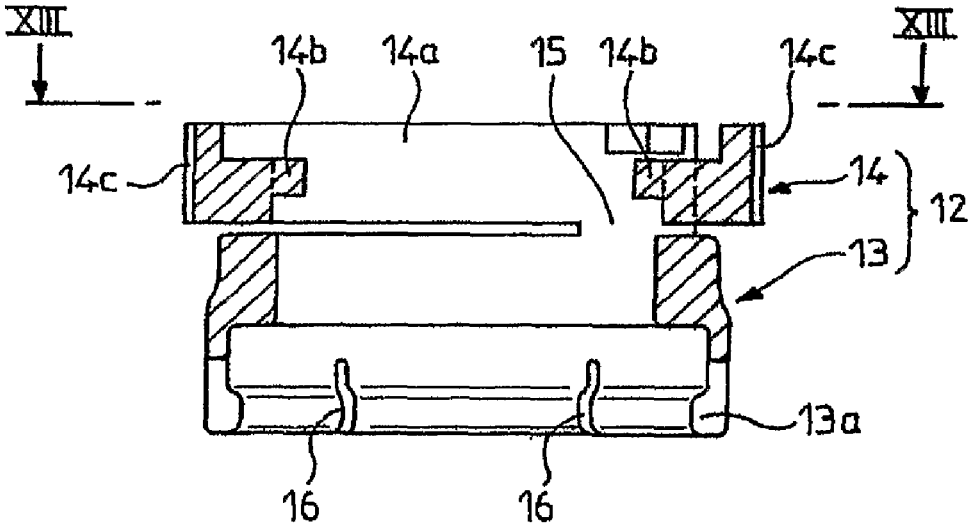
FIG. 14 represents a sectional view of the collar of FIG. 13 on XIV-XIV of FIG. 13.

The connection regions 15 are extended by rigid fingers 15*a* (FIGS. 3, 4, 7 and 13) on that side directed away from each of the elastic arms 14*a*, these fingers, as shown in FIG. 4, coming into contact with the arms 14*a* by lodging in the cutouts 14*d* (FIG. 13) of complementary shape made in the inner wall of the arms 14*a* when the user exerts a radial pressure on the pads 14*c*. In this position of the arms, the fingers 15*a* act as stops to keep the elastic arms in a horizontal plane.

The base 13 bears on its inner face, above the region where the slits 16 are located, a slight boss 13*b*, which is able to lodge in a slot 2*f* made at the same level in the cylindrical wall 2*c* of the valve pot 2, just above the border of the metal strip which provides external crimping at the ring 4. If the base 13 is caused to rotate with respect to the container 1, the slight boss 13*b* comes out of its housing 2*f* and bears on the cylindrical wall 2*c* of the valve pot 2. The boss 13*b* allows indexing of the angular position of the base 13 with respect to the container 1; this indexing corresponds to the studs 14*b* being positioned in line with the bottom points of the helical ramps 71, 72.

In order to move the dispensing stack 7-8 translationally with respect to the valve pot 2 so as to open the valve, the user presses on the pads 14*c*, which causes the latter to be brought into contact with the helical ramps 71, 72, and the user then performs a rotational movement in the direction in which the studs move along the said ramps towards the stops 73. In this case, given that the collar 12 is fixed in translation with respect to the container 1, the dispensing stack 7-8 moves downwards, that is to say causes the valve to open through the lowering of the valve element 10. It is essential in this rotation movement to prevent the studs 14*b* being raised vertically when they move with respect to the ramps 71, 72 under the effect of the pressure of the spring 6, in which case the collar 12 would no longer be fixed in translation with respect to the container 1 and the dispensing stack would not move downwards with respect to the valve pot. This function is carried out by the fingers 15*a*. It is also essential in this translational movement that the dispensing stack is unable to turn with respect to the valve pot. Consequently, there have been provided in the flanges 7*d* and 8*d* two respective pairs of grooves 17 and 17*a* which are parallel to the axis of the dispensing stack and cooperate with two pairs of ribs 18 formed on the inner face of the cylindrical wall 2*c* of the valve pot 2. One of the pairs of grooves/ribs (17, 18) and (17*a*, 18) is located on either side of the slot 2*f* which constitutes the housing of the slight boss 13*b*; a tongue 19 integral with the dispensing end-piece 7 has been formed between the two grooves (17, 17*a*) of this pair, which tongue penetrates a slot 20 made in the flange 8*d*; this tongue has a nib 19*a* at its free end. Placing the tongue 19 in the slot 20 makes it possible, by means of the nib 19*a*, for the dispensing end-piece 7 to be kept in place with respect to the valve-element holder 8; however, the dimensions of the nib 19*a* with respect to the slot 20 and to the play existing between the dispensing stack and the cylindrical wall 2*c* of the valve pot 2 make it possible, through the elasticity of the tongue 19, to uncouple the dispensing end-piece 7 from the valve-element holder 8 by pulling on the dispensing end-piece parallel to its axis. In this way the dispensing end-piece can be removed, allowing it to be cleaned between two successive dispensing operations.

The receptacle according to the invention is assembled by first of all fastening the valve pot on the container 1 by crimping. Next, the spring 6 is put in place followed by the valve-element holder 8 and, while compressing the spring 6, the valve element 10 is fixed in its retaining sleeve 8*b*. The compressing action on the spring 6 is released and the dispensing end-piece 7 is positioned on the valve-element holder 8, which entails snap-fastening of the tongue 19. The valve-element holder 8 and the dispensing end-piece 7 are installed with engagement of the ribs 18 in the grooves (17, 17*a*). The collar 12 is then fitted by snap-fastening the base 13 on the crimping ring 4, the boss 13*b* being placed in its slot 2*f*. The studs 14*b* now face the bottom points of the helical ramps 71, 72.

The receptacle which has just been described is put to use by the user acting on the pads 14*c*. When the valve is in the closed state, the studs 14*b* are released outwardly with respect to the helical ramps 71, 72 because of the elasticity of the arms 14*a*, this making it possible for the dispensing end-piece 7 to be removed for cleaning. When the end-piece 7 is repositioned after cleaning, the tongue 19 snap-fastens into the slot 20; the ribs 18 are engaged in the grooves (17, 17*a*), which prevents any rotation of the dispensing stack with respect to the valve pot 2. When the user presses on the pads 14*c* and exerts a rotational force on the collar 12, the studs 14*b* bear on the helical ramps 71, 72, which causes translational movement of the dispensing stack towards the inside of the container 1; however, the dispensing stack is unable to turn about its axis by virtue of the cooperation of the grooves (17, 17*a*) with the ribs 18. At the start of the movement, the slight boss 13*b* was housed in its slot 2*f*, which ensured that the studs were located in line with the bottom point of the helical ramps 71, 72. Rotating the collar 12 with respect to the container 1 causes the valve element 10 to be lowered, the sealing between the seal 11 and the valve-element seat 5 to be removed and, consequently, the product to be discharged under the effect of the pressure which exists in the container 1. Maximum opening is achieved when the studs 14*b* come into contact with the stops 73. If an excessive force is accidentally exerted by the user, causing the studs 14to pass beyond the stop, these studs drop down in line with the bottom point of the helical ramp on which they were not initially located, which immediately causes the valve to close under the action of the spring 6: this arrangement allows the dispensing operation to be carried out safely.

The important advantage of the receptacle according to the invention is that the product is discharged with very little pressure drop since the only passage where the cross section is slightly restricted is that which corresponds to the crossing of the valve-element seat 5. The pressure drop in the product as it exits is therefore minimum, which makes it possible to dispense a high-viscosity product, such as an ice-cream, for example.

The invention claimed is:

1. Pressurized receptacle for dispensing a viscous product comprising: a container comprising a dispensing valve having a valve pot fastened on the container and a valve element which is secured to a dispensing stack which moves translationally in a sealed manner with respect to the valve pot and which is subjected to the action of a spring, the valve element cooperating with a seat borne by the valve pot in order to close the valve under the action of the spring the spring compressing in order to open the valve by an operating means actuated by a user, the operating means acting on the dispensing stack while bearing on the container such that the product to be dispensed is ejected from the receptacle through the valve and the dispensing stack, the dispensing stack comprising on its outside, on a side directed away from the valve, at least one helical ramp having an axis that is the same as the valve and the operating means comprises a rotary collar fixed in translation with respect to the container, the collar having at least one stud which cooperates with the helical ramp to cause a translational movement of the dispensing stack when the collar is rotated.

2. Pressurized receptacle for dispensing a viscous product comprising: a container comprising a dispensing valve having a valve pot fastened on the container and a valve element which is secured to a dispensing stack which moves translationally in a sealed manner with respect to the valve pot and which is subjected to the action of a spring, the valve element cooperating with a seat borne by the valve pot in order to close the valve under the action of the spring the spring compressing in order to open the valve by an operating means actuated by a user, the operating means acting on the dispensing stack while bearing on the container such that the product to be dispensed is ejected from the receptacle through the valve and the dispensing stack, the dispensing stack comprising on its outside, on a side directed away from the valve, at least one helical ramp having an axis that is the same as the valve and the operating means comprises a rotary collar fixed in translation with respect to the container, the collar comprising at least one stud which cooperates with the helical ramp to cause a translational movement of the dispensing stack when the collar is rotated, wherein the stud of the collar moves substantially radially with respect to their helical bearing ramp between a first position in which there is a cooperation of the stud with its associated ramp under the effect of an action by the user and a second position in which there is no stud and ramp cooperation, the collar further comprising a base fastened on an attachment means for the container and of a support for the stud, and two diametrically opposed studs, the support for the stud comprises an elastic arm for each stud, each of the elastic arms of the collar is joined by one of its ends to the base by a connection region and has a stud at its other end, the connection regions extend on a side directed away from each of the elastic arms by rigid fingers which act as stops for maintaining the elastic arms in a horizontal plane when the user actuates the operating means by rotating the collar.

3. Pressurized receptacle for dispensing a viscous product comprising: a container comprising a dispensing valve having a valve pot fastened on the container and a valve element which is secured to a dispensing stack which moves translationally in a sealed manner with respect to the valve pot and which is subjected to the action of a spring, the valve element cooperating with a seat borne by the valve pot in order to close the valve under the action of the spring the spring compressing in order to open the valve by an operating means actuated by a user, the operating means acting on the dispensing stack while bearing on the container such that the product to be dispensed is ejected from the receptacle through the valve and the dispensing stack, the dispensing stack comprising on its outside, on a side directed away from the valve, two helical ramps having an axis that is the same as the valve and the operating means comprises a rotary collar fixed in translation with respect to the container, the collar having at least one stud which cooperates with the helical ramps to cause a translational movement of the dispensing stack when the collar is rotated, wherein the dispensing stack has a body of revolution about an axis and the two helical ramps are symmetrical with respect to the axis, and wherein the valve-element holder has a peripheral flange, the spring being a helical spring arranged between the flange and the bottom of a cylindrical region of the valve pot in the form of a pocket, the sliding of the valve-element holder being guided with respect to the valve pot by the wall of the pocket which is closest to the axis of the dispensing stack, a seal being provided between the valve-element holder and the wall of the pocket.

4. Pressurized receptacle for dispensing a viscous product comprising: a container comprising a dispensing valve having a valve pot fastened on the container and a valve element which is secured to a dispensing stack which moves translationally in a sealed manner with respect to the valve pot and which is subjected to the action of a spring, the valve element cooperating with a seat borne by the valve pot in order to close the valve under the action of the spring the spring compressing in order to open the valve by an operating means actuated by a user, the operating means acting on the dispensing stack while bearing on the container such that the product to be dispensed is ejected from the receptacle through the valve and the dispensing stack, the dispensing stack comprising on its outside, on a side directed away from the valve, two helical ramps having an axis that is the same as the valve and the operating means comprises a rotary collar fixed in translation with respect to the container, the collar having at least one stud which cooperates with the helical ramp to cause a translational movement of the dispensing stack when the collar is rotated, wherein the dispensing stack has a body of revolution about an axis and the two helical ramps are symmetrical with respect to the axis, and wherein the valve-element holder has a peripheral flange having at least one slot which receives a tongue integral with the dispensing end-piece, the tongue providing a removable coupling between the dispensing end-piece and the valve-element holder to allow uncoupling of the end-piece, the spring being a helical spring arranged between the flange and the bottom of a cylindrical region of the valve pot in the form of a pocket, the sliding of the valve-element holder being guided with respect to the valve pot by the wall of the pocket which is closest to the axis of the dispensing stack, a seal being provided between the valve-element holder and the wall of the pocket.

5. Pressurized receptacle for dispensing a viscous product comprising: a container comprising a dispensing valve having a valve pot fastened on the container and a valve element which is secured to a dispensing stack which moves translationally in a sealed manner with respect to the valve pot and which is subjected to the action of a spring, the valve element cooperating with a seat borne by the valve pot in order to close the valve under the action of the spring the spring compressing in order to open the valve by an operating means actuated by a user, the operating means acting on the dispensing stack while bearing on the container such that the product to be dispensed is ejected from the receptacle through the valve and the dispensing stack, the dispensing stack comprising on its outside, on a side directed away from the valve, two helical ramps having an axis that is the same as the valve and the operating means comprises a rotary collar fixed in translation with respect to the container, the collar having at least one stud which cooperates with the helical ramp to cause a translational movement of the dispensing stack when the collar is rotated, wherein the dispensing stack has a body of revolution about an axis and the two helical ramps are symmetrical with respect to the axis, and wherein the valve-element holder has a peripheral flange having at least one slot which receives a tongue integral with the dispensing end-piece, the tongue being positioned between the two grooves of a pair of grooves of the dispensing stack and providing a removable coupling between the dispensing end-piece and the valve-element holder to allow uncoupling of the end-piece, the spring being a helical spring arranged between the flange and the bottom of a cylindrical region of the valve pot in the form of a pocket, the sliding of the valve-element holder being guided with respect to the valve pot by the wall of the pocket which is closest to the axis of the dispensing stack, a seal being provided between the valve-element holder and the wall of the pocket.

6. Pressurized receptacle for dispensing a viscous product comprising: a container comprising a dispensing valve having a valve pot fastened on the container and a valve element which is secured to a dispensing stack which moves translationally in a sealed manner with respect to the valve pot and which is subjected to the action of a spring, the valve element cooperating with a seat borne by the valve pot in order to close the valve under the action of the spring the spring compressing in order to open the valve by an operating means actuated by a user, the operating means acting on the dispensing stack while bearing on the container such that the product to be dispensed is ejected from the receptacle through the valve and the dispensing stack, the dispensing stack comprising on its outside, on a side directed away from the valve, at least one helical ramp having an axis that is the same as the valve and the operating means comprises a rotary collar fixed in translation with respect to the container, the collar having at least one stud which cooperates with the helical ramp to cause a translational movement of the dispensing stack when the collar is rotated, wherein the stud of the collar moves substantially radially with respect to their helical bearing ramp between a first position in which there is a cooperation of the stud with its associated ramp under the effect of an action by the user and a second position in which there is no stud and ramp cooperation, wherein the collar comprises a base fastened on an attachment means for the container and of a support for the stud, and wherein the collar comprises on the inner face of its base a boss which is located in a window made in the valve pot on a side of the crimping flange where the valve element is not located.

7. Pressurized receptacle for dispensing a viscous product comprising: a container comprising a dispensing valve having a valve pot fastened on the container and a valve element which is secured to a dispensing stack which moves translationally in a sealed manner with respect to the valve pot and which is subjected to the action of a spring, the valve element cooperating with a seat borne by the valve pot in order to close the valve under the action of the spring the spring compressing in order to open the valve by an operating means actuated by a user, the operating means acting on the dispensing stack while bearing on the container such that the product to be dispensed is ejected from the receptacle through the valve and the dispensing stack, the dispensing stack comprising on its outside, on a side directed away from the valve, at least one helical ramp having an axis that is the same as the valve and the operating means comprises a rotary collar fixed in translation with respect to the container, the collar having at least one stud which cooperates with the helical ramp to cause a translational movement of the dispensing stack when the collar is rotated, wherein the stud of the collar moves substantially radially with respect to their helical bearing ramp between a first position in which there is a cooperation of the stud with its associated ramp under the effect of an action by the user and a second position in which there is no stud and ramp cooperation, wherein the collar comprises a base fastened on an attachment means for the container and of a support for the stud, the collar further comprising two diametrically opposed studs and the support for the stud comprises an elastic arm for each stud, wherein when the user rotates the collar, a boss projects from a window by deformation of the base, the position of the window on the valve pot corresponding, when the boss is housed therein, to a position of the collar in which the two studs are in line with the bottom points of two helical ramps.

8. Pressurized receptacle for dispensing a viscous product comprising: a container comprising a dispensing valve having a valve pot fastened on the container and a valve element which is secured to a dispensing stack which moves translationally in a sealed manner with respect to the valve pot and which is subjected to the action of a spring, the valve element cooperating with a seat borne by the valve pot in order to close the valve under the action of the spring the spring compressing in order to open the valve by an operating means actuated by a user, the operating means acting on the dispensing stack while bearing on the container such that the product to be dispensed is ejected from the receptacle through the valve and the dispensing stack, the dispensing stack comprising on its outside, on a side directed away from the valve, at least one helical ramp having an axis that is the same as the valve and the operating means comprises a rotary collar fixed in translation with respect to the container, the collar having at least one stud which cooperates with the helical ramp to cause a translational movement of the dispensing stack when the collar is rotated, wherein the stud of the collar moves substantially radially with respect to their helical bearing ramp between a first position in which there is a cooperation of the stud with its associated ramp under the effect of an action by the user and a second position in which there is no stud and ramp cooperation.

9. Receptacle according to claim 8, wherein the collar comprises a base fastened on an attachment means for the container and of a support for the stud.

10. Receptacle according to claim 9, wherein the collar comprises two diametrically opposed studs and the support for the stud comprises an elastic arm for each stud.

11. Receptacle according to claim 9, wherein a region of the container where the valve is fastened is a body of revolution about an axis and the attachment means for the container is a crimping bead that is a body of revolution about the axis, the bead providing the connection between the container and a crimping flange of the valve pot.

12. Pressurized receptacle for dispensing a viscous product comprising: a container comprising a dispensing valve having a valve pot fastened on the container and a valve element which is secured to a dispensing stack which moves translationally in a sealed manner with respect to the valve pot and which is subjected to the action of a spring, the valve element cooperating with a seat borne by the valve pot in order to close the valve under the action of the spring the spring compressing in order to open the valve by an operating means actuated by a user, the operating means acting on the dispensing stack while bearing on the container such that the product to be dispensed is ejected from the receptacle through the valve and the dispensing stack, the dispensing stack comprising on its outside, on a side directed away from the valve, at least one helical ramp having an axis that is the same as the valve and the operating means comprises a rotary collar fixed in translation with respect to the container, the collar having at least one stud which cooperates with the helical ramp to cause a translational movement of the dispensing stack when the collar is rotated, wherein the dispensing stack has a body of revolution about an axis and two helical ramps are symmetrical with respect to the axis.

13. Receptacle according to claim 12, wherein each of the elastic arms of the collar is joined by one of its ends to the base by a connection region and has a stud at its other end.

14. Receptacle according to claim 12, wherein the dispensing end-piece comprises on its outside two helical ramps of the dispensing stack and has a cylindrical housing in the form of a pocket which can be fitted over a part of the valve-element holder located on that side of its flange where the valve element is not located.

15. Pressurized receptacle for dispensing a viscous product comprising: a container comprising a dispensing valve having a valve pot fastened on the container and a valve element which is secured to a dispensing stack which moves translationally in a sealed manner with respect to the valve pot and which is subjected to the action of a spring, the valve element cooperating with a seat borne by the valve pot in order to close the valve under the action of the spring the spring compressing in order to open the valve by an operating means actuated by a user, the operating means acting on the dispensing stack while bearing on the container such that the product to be dispensed is ejected from the receptacle through the valve and the dispensing stack, the dispensing stack comprising on its outside, on a side directed away from the valve, at least one helical ramp having an axis that is the same as the valve and the operating means comprises a rotary collar fixed in translation with respect to the container, the collar having at least one stud which cooperates with the helical ramp to cause a translational movement of the dispensing stack when the collar is rotated, wherein the dispensing stack comprises two coaxial cylindrical parts, one part being a valve-element holder which is secured to the valve element and slides in a sealed manner in the valve pot, the other part comprising a dispensing end-piece which forms a liner inside the valve-element holder.

16. Pressurized receptacle for dispensing a viscous product comprising: a container comprising a dispensing valve having a valve pot fastened on the container and a valve element which is secured to a dispensing stack which moves translationally in a sealed manner with respect to the valve pot and which is subjected to the action of a spring, the valve element cooperating with a seat borne by the valve pot in order to close the valve under the action of the spring the spring compressing in order to open the valve by an operating means actuated by a user, the operating means acting on the dispensing stack while bearing on the container such that the product to be dispensed is ejected from the receptacle through the valve and the dispensing stack, the dispensing stack comprising on its outside, on a side directed away from the valve, at least one helical ramp having an axis that is the same as the valve and the operating means comprises a rotary collar fixed in translation with respect to the container, the collar having at least one stud which cooperates with the helical ramp to cause a translational movement of the dispensing stack when the collar is rotated, wherein the dispensing stack and the valve pot are prevented from rotating relative to one another by virtue of an arrangement of grooves and ribs parallel to the axis of the dispensing stack.

17. Receptacle according to claim 16, wherein the valve pot has on its inside two diametrically opposed pairs of ribs and the dispensing stack has, at its periphery, two corresponding pairs of grooves.

* * * * *